US006203015B1

(12) United States Patent
Yarbrough

(10) Patent No.: US 6,203,015 B1
(45) Date of Patent: Mar. 20, 2001

(54) PUZZLE AND METHOD OF ASSEMBLY

(76) Inventor: Lynn D. Yarbrough, 40235 Washington St., Apt A11, Palm Desert, CA (US) 92211

( * ) Notice: Subject to any disclaimer, the term of this patent is extended or adjusted under 35 U.S.C. 154(b) by 0 days.

(21) Appl. No.: 09/258,737

(22) Filed: Feb. 26, 1999

(51) Int. Cl.[7] ..... A63F 9/12
(52) U.S. Cl. ..... 273/160
(58) Field of Search ..... 273/153 R, 156, 273/160, 157 R; 446/106, 124, 125, 127

(56) References Cited

U.S. PATENT DOCUMENTS

| | | | | |
|---|---|---|---|---|
| 393,816 | * | 12/1888 | Chandler | 273/160 |
| 3,303,604 | * | 2/1967 | Mote | 273/160 |
| 3,372,936 | * | 3/1968 | Sanson | 273/160 |
| 3,721,448 | * | 3/1973 | Coffin | 273/160 |
| 4,113,256 | * | 9/1978 | Hutchings | 273/160 |
| 4,676,507 | * | 6/1987 | Patterson | 273/160 |
| 5,118,111 | * | 6/1992 | Suitor | 273/160 |
| 5,846,114 | * | 12/1998 | Frandsen, II | 446/106 |

FOREIGN PATENT DOCUMENTS

| | | | | |
|---|---|---|---|---|
| 3150260 | * | 7/1983 | (DE) | 273/160 |

* cited by examiner

*Primary Examiner*—Steven Wong
(74) *Attorney, Agent, or Firm*—Russo & Hale LLP; William C. Milks, III

(57) ABSTRACT

A puzzle consists of six or more elongated pieces. Each piece has a polygonal cross-section and a cavity whose dimensions are determined by the polygonal cross-section. The pieces can be arranged in two opposing groups of three or more pieces each, arranged substantially in parallel, and such that the cavity in each piece is filled by portions of other pieces as the groups are advanced toward each other. The pieces can be assembled and disassembled only in such a way that each piece is moved relative to others in a different direction to interlock the pieces in an assembled configuration, and no individual piece can be disengaged from the assembled configuration without disengaging all of the pieces.

19 Claims, 11 Drawing Sheets

PUZZLE AND METHOD OF ASSEMBLY

BACKGROUND OF THE INVENTION

I. Field of the Invention

The present invention relates generally to the interconnection of solid objects, and, more particularly, to three-dimensional geometric and mechanical puzzles. Specifically, one embodiment of the present invention provides a mechanical puzzle consisting of six or more elongated pieces having a polygonal cross-section and a method of assembly characterized by movement of the pieces being assembled in different directions simultaneously.

II. Description of the Prior Art

Means and methods of connecting solid objects have contributed to the advancement of the building industry for many generations. Log cabins using slotted logs as building members are well known. Mortise-and-tenon joints are commonplace in wooden furniture construction.

Also, three-dimensional geometric and mechanical puzzles have been used as a source of entertainment and mental challenge for many years. Such puzzles may appeal both to the intellect and the aesthetic sense of the solver. They typically consist of a plurality of pieces which when properly manipulated will interlock in an assembly to form one or more predetermined geometric shapes. See, for example, U.S. Pat. No. 3,721,448.

The number of techniques for connecting the pieces of a mechanical puzzle appears to be limited, and, consequently, the discovery of a new configuration attracts interest from solvers and collectors. The interest arises from practical considerations such as stability as well as difficulty in assembly and disassembly, and also aesthetic considerations such as symmetry.

One type of mechanical puzzle is known as a "coordinate-motion" puzzle. See, Coffin, Stewart T., *The Puzzling World of Polyhedral Dissections*, Oxford University Press: New York, 1990, Chap. 12. Such puzzles cannot be assembled sequentially, but rather at some stage of assembly they require the simultaneous manipulation of three or more pieces or groups of pieces. Certain puzzles of this type have been constructed in which all pieces must move simultaneously, inwardly during assembly and outwardly during disassembly. No known puzzle of this type has been developed in which identical pieces must move simultaneously in different directions, some inwardly and others outwardly, during both assembly and disassembly.

Additionally, no known coordinate-motion puzzle has been designed in the configuration of three or more pieces interlocked with three or more other pieces such that the total thickness of the assembled configuration is that of the span of a single piece. Such a shape would enhance the stability of the puzzle and simplify packing and shipping.

Moreover, known coordinate-motion puzzle configurations are not typically scaleable. Arrangements of the elongated pieces in which the interlocking mechanism is used at both ends or at several places along their length would allow the connection of large arrays of pieces to form complex structures.

SUMMARY OF THE INVENTION

The present invention provides a puzzle consisting of six or more pieces that are preferably identical except for nonessential decoration, length, or embellishment. The pieces typically have the shape of elongated bars of solid material with a polygonal cross-section, and each piece is provided with a cavity that enables pieces to interlock and grip each other. The cavity in each piece is dimensioned so as to permit three or more other pieces to fit parallel to each other within the cavity and at a substantially right angle to each piece in whose cavity the parallel pieces are disposed.

The puzzle in accordance with the present invention is assembled by dividing the pieces into two groups of at least three each, consisting of two or more outer pieces and at least one middle piece, and, for each group, placing the three or more pieces in each group together so that two or more outer pieces are parallel with the middle piece between them such that the cavities of all of the pieces in the group are oriented in the same direction. The two groups are then advanced toward each other, with the cavities of the pieces of the respective groups facing toward each other, until the outer pieces of the two groups are moved into contact with the floors of the cavities of the outer pieces of one group substantially perpendicular and disposed in close contact with the floors of the cavities of the outer pieces of the other group. The middle piece of each group is placed so that the points along one edge span the floors of the cavities of the outer pieces of the opposing group and reach beyond their edges, and then the outer pieces of each group are slid apart while the middle pieces are simultaneously slid toward the opposing group. When the middle pieces of the two groups meet, assembly is complete. In the assembled condition, the puzzle is stable.

The puzzle is disassembled by reversing the assembly procedure. Specifically, the puzzle is disassembled by pulling the middle piece of each group as far apart from each other as possible while simultaneously squeezing the outer pieces in each group toward each other, combining pulling and squeezing until all of the pieces separate.

In accordance with various embodiments of the puzzle in accordance with the present invention, the pieces can have various polygonal cross-sections. In one embodiment, for example, the pieces have a square cross-section. In another embodiment, the pieces have a hexagonal cross-section. Other cross-sections such as a pentagonal cross-section are also contemplated.

Furthermore, the puzzle of the present invention can consist of six or more pieces. In one embodiment, for example, the puzzle comprises an equal number of pieces in each opposing group of pieces. In another embodiment, the number of pieces in one group can differ from the number of pieces in the other group.

Also, the pieces can be identical, or the pieces can have different diagonal cross-sectional shapes or widths. For example, in a modified embodiment of the puzzle in which the pieces have a square cross-section, one or both of the two pieces comprising the middle piece of each group during assembly may have an arbitrary configuration on the portion of the piece which faces away from the opposing pieces when the puzzle is assembled. Examples of the precise relative dimensions of the pieces and cavities are shown in the accompanying drawings and described below.

BRIEF DESCRIPTION OF THE DRAWINGS

The above and other features and the concomitant advantages of the puzzle in accordance with the present invention will be better understood and appreciated by those persons skilled in the art after a consideration of the accompanying drawings in conjunction with the detailed description of the preferred embodiments that follows. In the drawings.

DETAILED DESCRIPTION OF THE PREFERRED EMBODIMENTS

Figure 1:
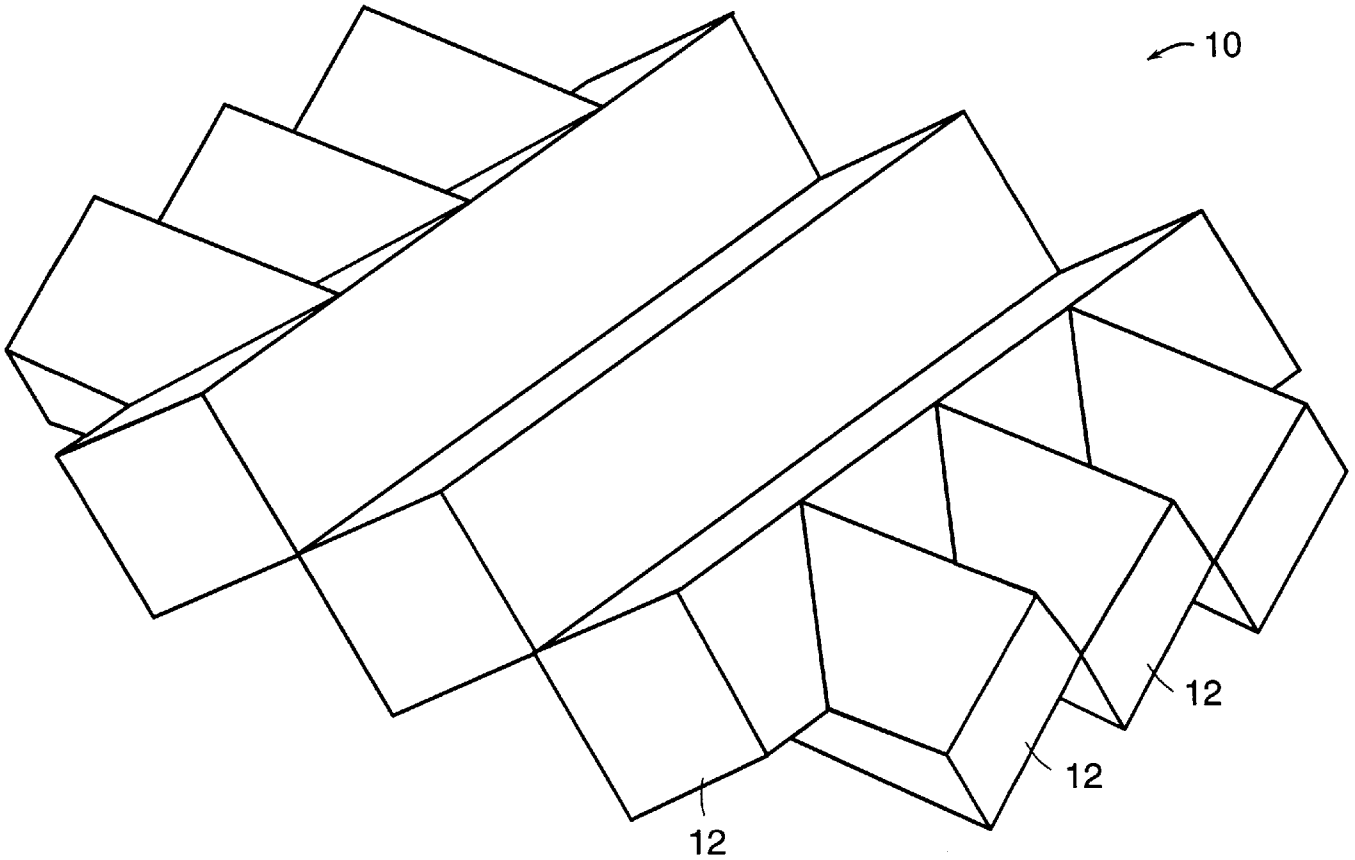
FIG. 1 is a perspective view of one embodiment of an assembled puzzle in accordance with the present invention.

One embodiment of the puzzle in accordance with the present invention, generally indicated by the numeral 10, is shown in FIG. 1 in assembled condition. The puzzle 10 comprises a plurality of pieces 12. For example, as shown in FIG. 1, the puzzle 10 consists of at least six pieces 12. Each piece 12 of the puzzle 10 is elongated and has a polygonal cross-sectional shape. For example, as shown in FIG. 1, each piece 12 has a square cross-section. As will be described in more detail later, the number of pieces can be greater than six, for example, seven, and the cross-sectional shape can be hexagonal, pentagonal, etc.

The pieces 12 are preferably constructed of a rigid material such as wood, metal, or bakelite or other hard plastic, of sufficient length to accommodate the cavities described below. The surfaces of the pieces 12 must be smooth enough to permit assembly or disassembly without damage.

Figure 2:
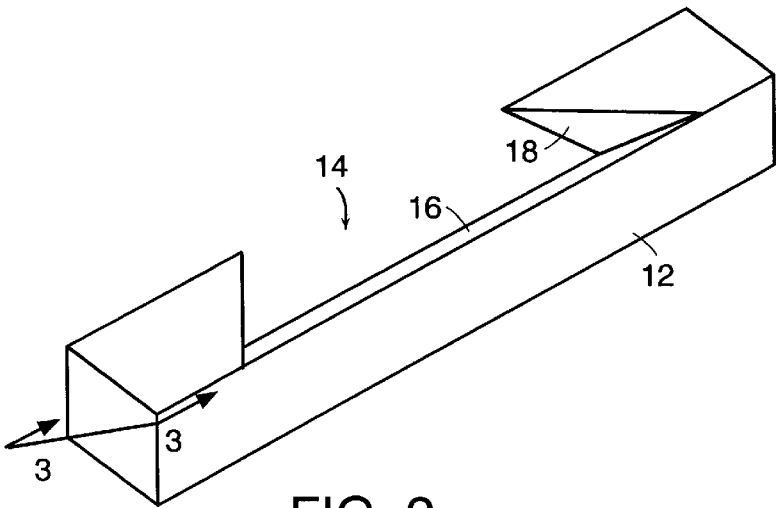
FIG. 2 is a perspective view of one of the pieces of the puzzle shown in FIG. 1.
Figure 3:
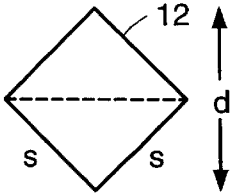
FIG. 3 is an end view of the puzzle piece shown in FIG. 2 along line 3—3 which appears in FIG. 2.

FIG. 2 is a perspective view of one of the pieces 12 of the puzzle 10 shown in FIG. 1. FIG. 3 is an end view of the piece 12 along the line 3—3 shown in FIG. 2. As shown in FIG. 3, the piece 12 has a square cross-section. In the case of the square cross-section, each side of the square has a dimension s. The length of a diagonal d of the square cross-sectional piece 12 is therefore approximately 1.414×s.

Figure 4:
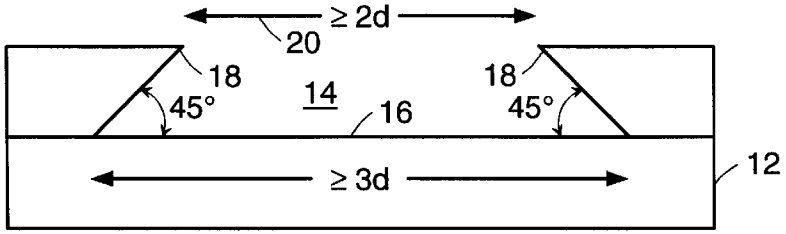
FIG. 4 is a side view of the puzzle piece shown in FIG. 2.
Figure 5:
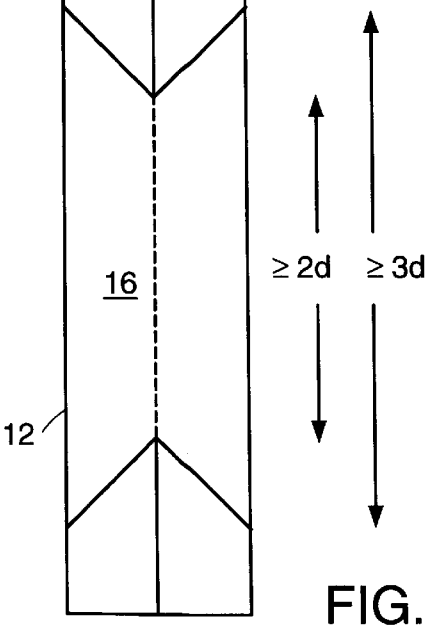
FIG. 5 is a top plan view of the puzzle piece shown in FIG. 2.

As shown in FIGS. 2, 4, and 5, each piece 12 comprises a cavity 14 having a floor 16 and two end walls 18. Preferably, the floor 16 and end walls 18 are substantially flat and smooth to provide an even surface when contacted by another piece 12 to provide a bearing or contact surface during assembly and to assure proper fit when the pieces are in the assembled condition. The cavity 14 extends from one end of the piece 12, which intersects one end wall 18, to another end, which intersects the other end wall 18. In the case in which each piece 12 has a square cross-section, the interior angles of the end walls 18 of the cavity 14 with respect to the floor 16 of the cavity are each 45°, as shown in FIG. 4.

As shown in FIG. 5, the floor 16 of the cavity 14 spans the diagonal width of the piece 12. The dimensions of the cavity 14 are such that an opening 20 along one edge of the piece 12 is at least 2.0×d, and the floor 16 of the cavity is rectangular having a width with a dimension d and a length at least 3.0×d. With these dimensions for the cavity 14, the floors 16 of two other pieces 12 can pass side-by-side through the opening 20 along the one edge of another piece, and the cavities of three pieces can be disposed within the cavity of any one piece or the cavities of as many as three side-by-side pieces. The length of each piece 12 must be greater than the length of the cavity 14.

Figure 6:
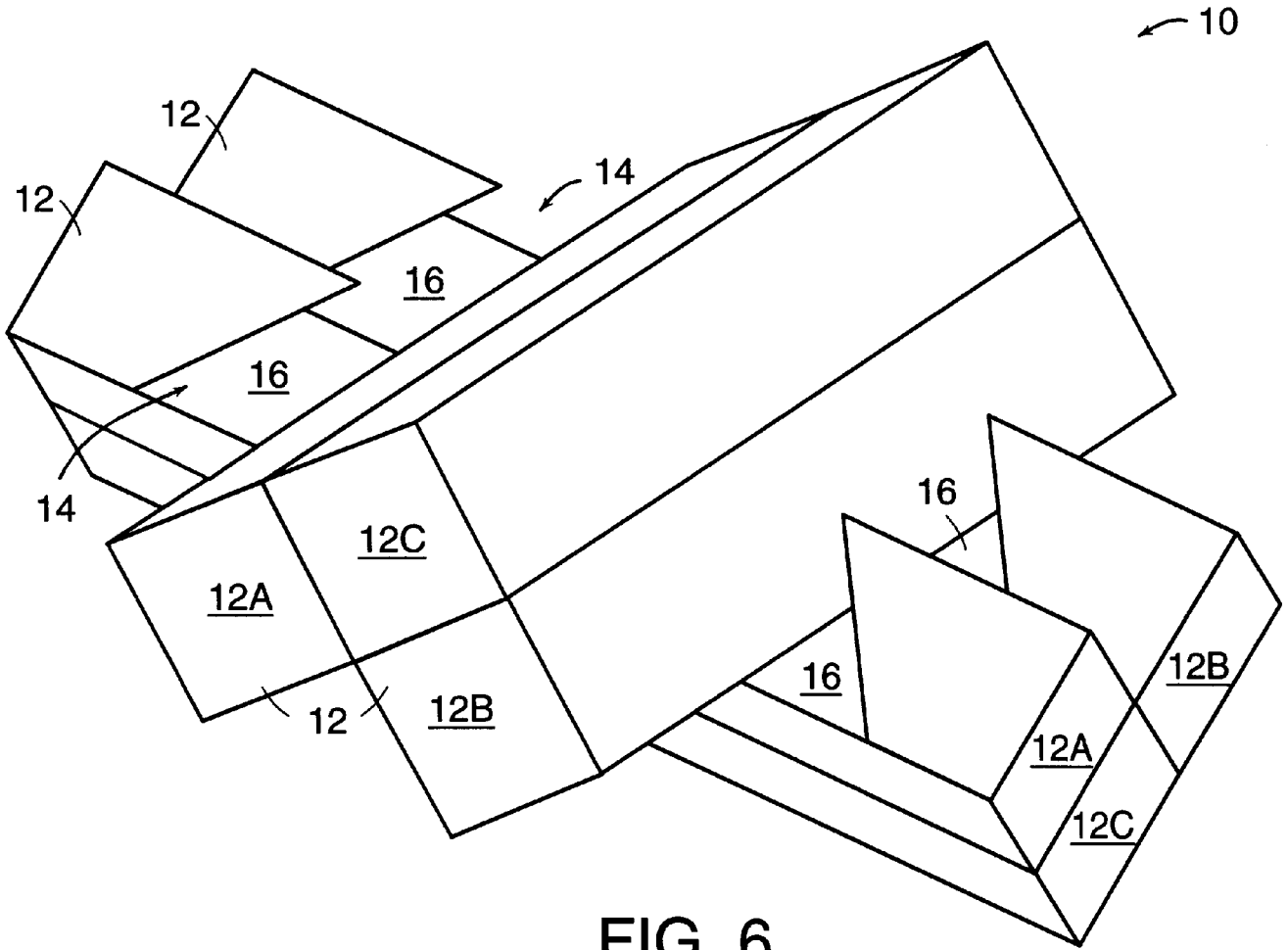
FIG. 6 is a perspective view of the puzzle shown in FIG. 1 as assembly is commenced.

The puzzle 10, whose assembled condition is shown in FIG. 1, is assembled as follows. First, the six pieces 12 comprising the puzzle 10 are grouped into two sets of three pieces, as shown in FIG. 6. Each group consists of two outer pieces 12A and 12B and one middle piece 12C. For each group, the three pieces 12A, 12B, and 12C are placed together so that the two outer pieces 12A and 12B are side-by-side and edge-to-edge with the middle piece 12C between them such that the cavities 14 of all of the pieces in the group are oriented in the same direction. The two groups of pieces 12 are then advanced toward each other, with the cavities 14 of the pieces of the respective groups facing toward each other, until the outer pieces of the two groups are moved into contact with the floors 16 of the cavities of the two outer pieces 12A and 12B of one group oriented substantially perpendicular and disposed in close contact with the floors of the cavities of the two outer pieces of the other group. Also, the middle piece 12C of each group is placed so that the points along the edge on either side of the opening 20 of the cavity 14 span the floors 16 of the cavities of the outer pieces 12A and 12B of the opposing group and reach beyond the edges of the outer pieces of that opposing group.

Figure 7:
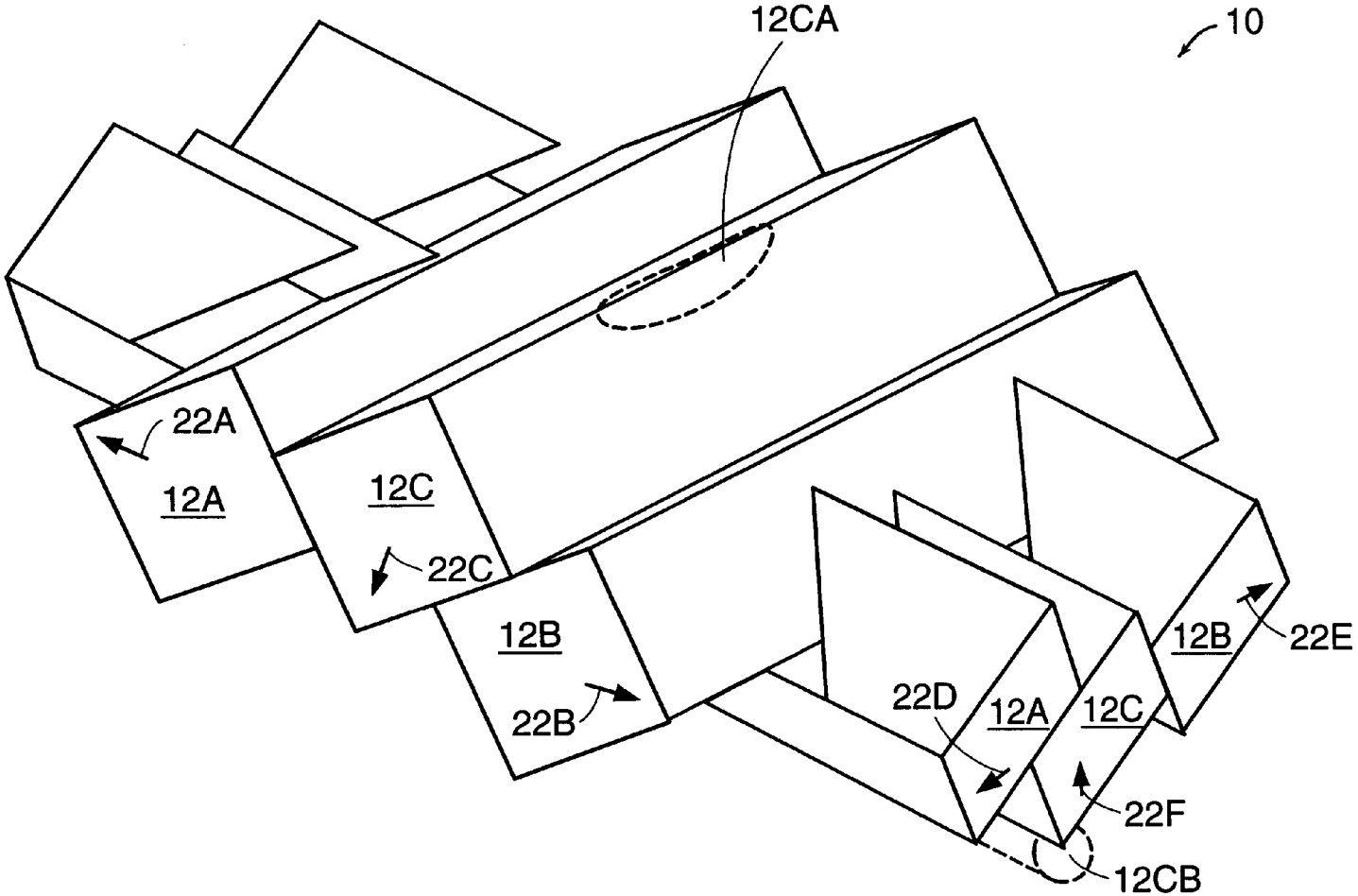
FIG. 7 is a perspective view of the puzzle shown in FIG. 1 while the puzzle is being assembled.

Then, as shown in FIG. 7, the side-by-side outer pieces 12A and 12B of each group are slid apart, while the middle pieces 12C are simultaneously slid toward the opposing group. Considered in more detail, the pieces 12 are slid in the directions of the arrows 22A, 22B, 22C, 22D, 22E, and 22F simultaneously. No two pieces move in the same direction. The movement of all pieces 12 is substantially rectilinear. When the floors 16 of the cavities 14 of the middle pieces 12C of the two groups meet, assembly is complete. In the assembled condition, the puzzle 10 is held by friction in a stable state.

Figure 8:
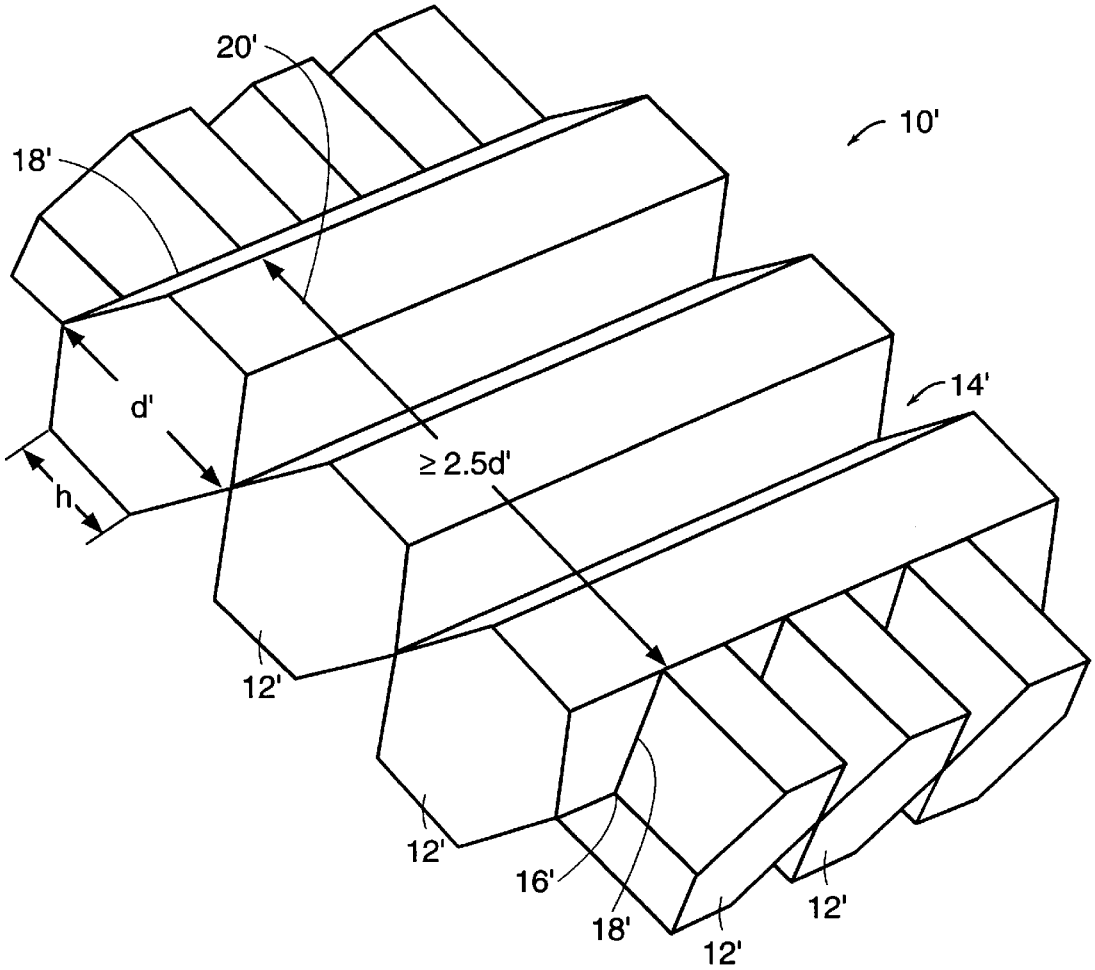
FIG. 8 is a perspective view of another embodiment of an assembled puzzle in accordance with the present invention.

Another embodiment of the puzzle in accordance with the present invention, indicated by the numeral 10', is shown in FIG. 8 in assembled condition. As shown in FIG. 8, the puzzle 10' consists of six pieces 12', each of which has a hexagonal cross-section. In the case of the pieces 12' having a hexagonal cross-section, each side of the hexagon has dimension h. The length of the diagonal d' is 2.0×h. Each piece 12' has a cavity 14' with a floor 16' and two end walls 18'. The cavity 14' extends from one end wall 18' to the opposite end wall in such a way that the interior angles of the end walls of the cavity 14' with respect to the floor 16' of the cavity are each 60°. The floor 16' of the cavity 14' spans the diagonal width of the piece 12'. The dimensions of the cavity 14' are such that the length of the opening 20' along one edge is at least 2.5×d', and the floor 16' of the cavity is rectangular having a width d' by a length of at least 3.0×d'. The length of each piece 12' must be greater than the length of the cavity 14'.

Figure 9:
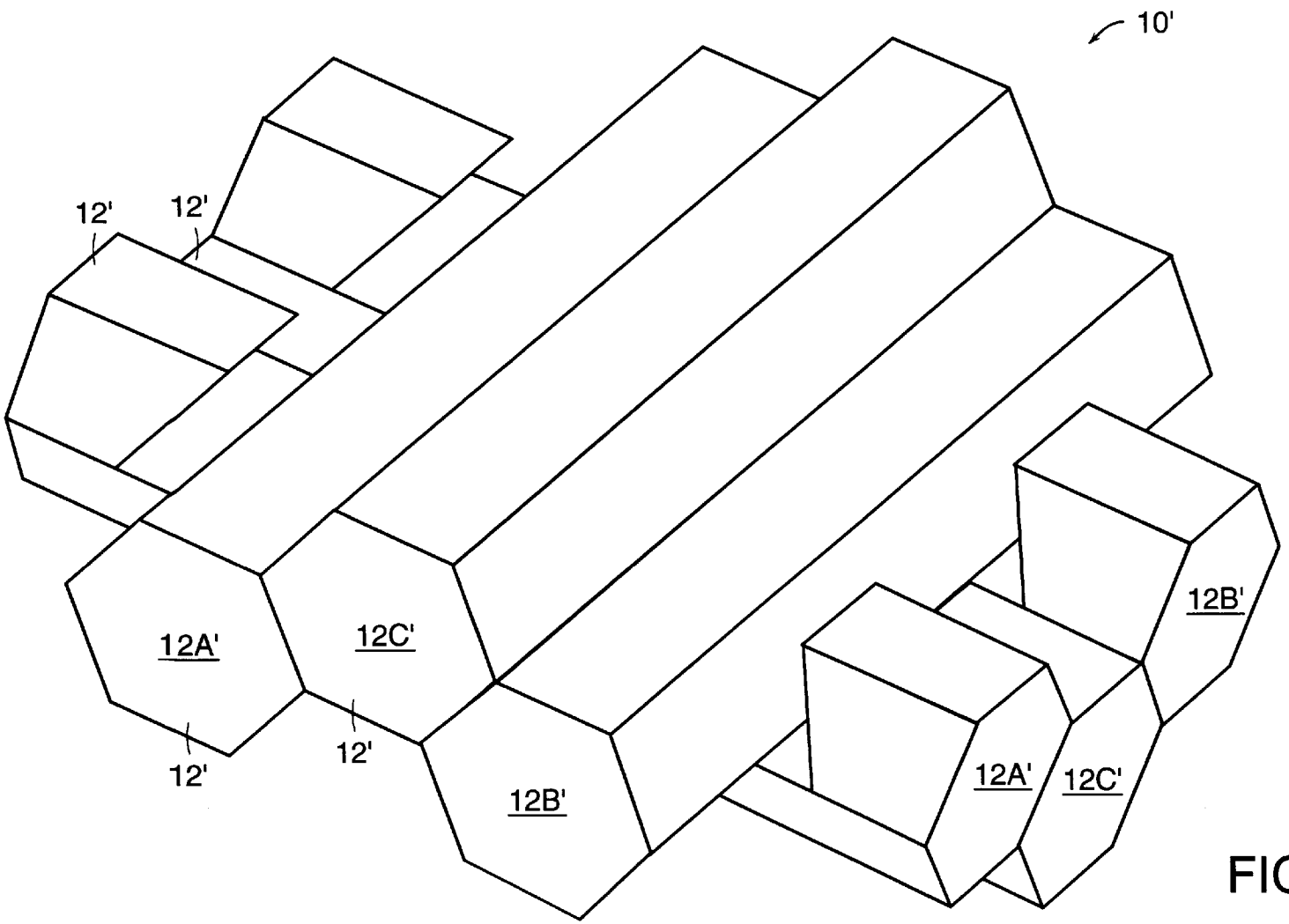
FIG. 9 is a perspective view of the puzzle shown in FIG. 8 as assembly is commenced.

The puzzle 10', whose assembled condition is shown in FIG. 8, is assembled as follows. First, the six pieces 12' comprising the puzzle 10' are grouped into two sets of three pieces, as shown in FIG. 9. Each group consists of two outer pieces 12A' and 12B' and one middle piece 12C'. For each group, the three pieces are placed together so that the two outer pieces 12A' and 12B' are separated by a distance h with the middle piece 12C' between them such that the cavities 14' of all of the pieces in the group are oriented in the same direction. The two groups of pieces 12' are then advanced toward each other, with the cavities 14' of the pieces of the respective groups facing toward each other, until the outer pieces of the two groups are moved into contact with the floors 16' of the cavities of the two outer pieces 12A' and 12B ' of one group oriented perpendicular and disposed in close contact with the floors of the cavities of the two outer pieces of the other group. Also, the middle piece 12C' of each group is placed so that the points along the edge on either side of the opening 20' of the cavity 14' span the floors 16' of the cavities of the outer pieces 12A' and 12B' of the opposing group and reach beyond the edges of the outer pieces of that opposing group.

Figure 10:
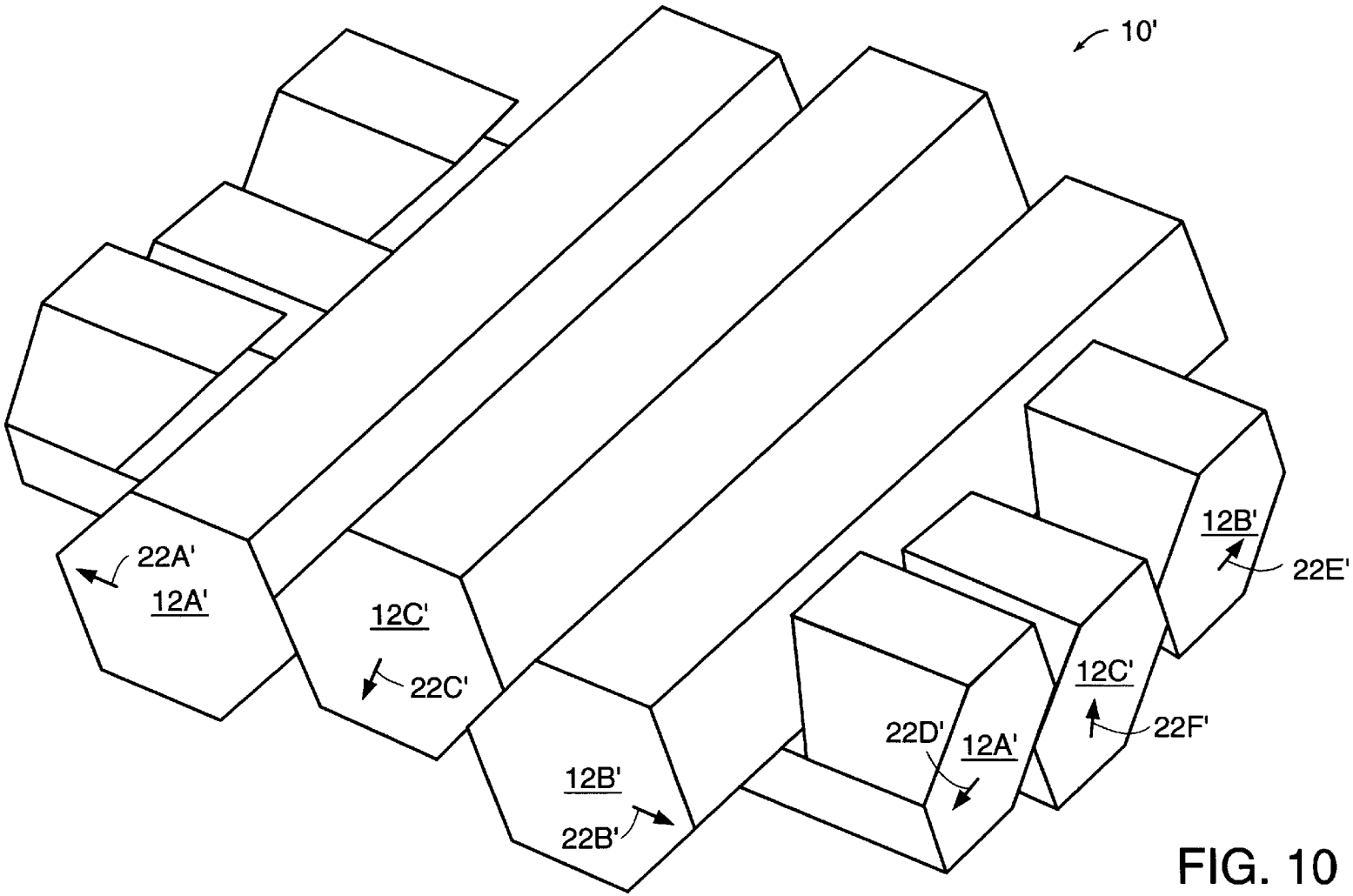
FIG. 10 is a perspective view of the puzzle shown in FIG. 8 while the puzzle is being assembled.

Then, as shown in FIG. 10, the outer pieces 12A' and 12B' of each group are slid apart, while the middle pieces 12C' are simultaneously slid toward the opposing group. Considered in more detail, the pieces 12' are slid in the directions of the arrows 22A', 22B', 22C', 22D', 22E', and 22F' simultaneously. No two pieces move in the same direction. The movement of all pieces 12' is substantially rectilinear. When the floors 16' of the cavities 14' of the middle pieces 12C' of the two groups meet, assembly is complete. In the assembled condition, the puzzle 10' is held by friction in a stable state.

Figure 11:
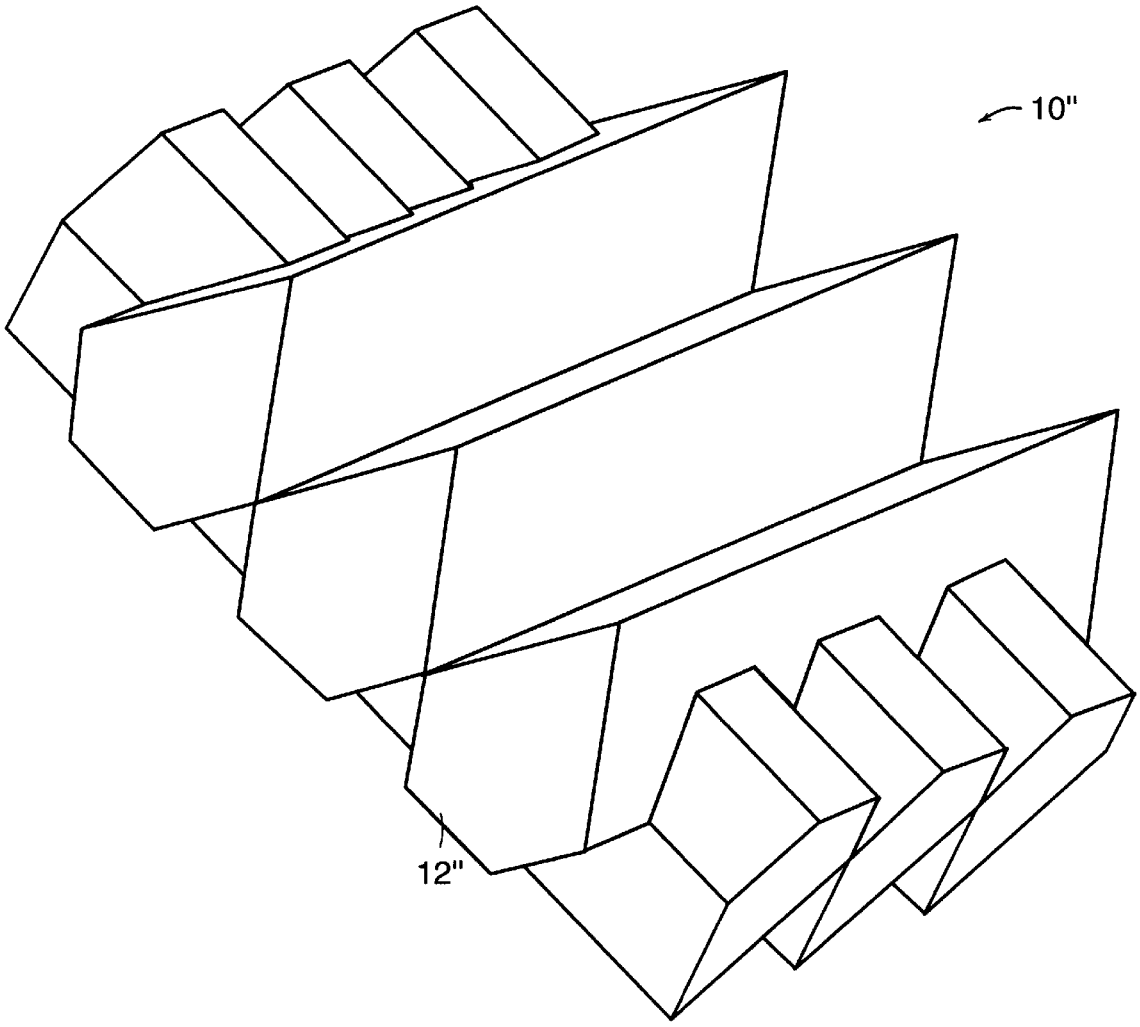
FIG. 11 is a perspective view of a further embodiment of an assembled puzzle in accordance with the present invention.

FIG. 11 shows another embodiment of the puzzle in accordance with the present invention, indicated by the numeral 10", which is similar to the puzzle 10' shown in FIG. 8, except that the cross-section of each piece 12" is a pentagon, rather than a hexagon. The pieces 12" shown in FIG. 11 can be formed by extending two of the faces of a hexagonal piece shown in FIG. 8 until they meet to form an edge. In contrast to the hexagonal pieces 12' shown in FIG. 8, the pieces 12" shown in FIG. 11 do not have a symmetrical cross-section. However, the pieces 12" are otherwise constructed and assembled as described in connection with the embodiment described in connection with FIGS. 8–10.

Figure 12:
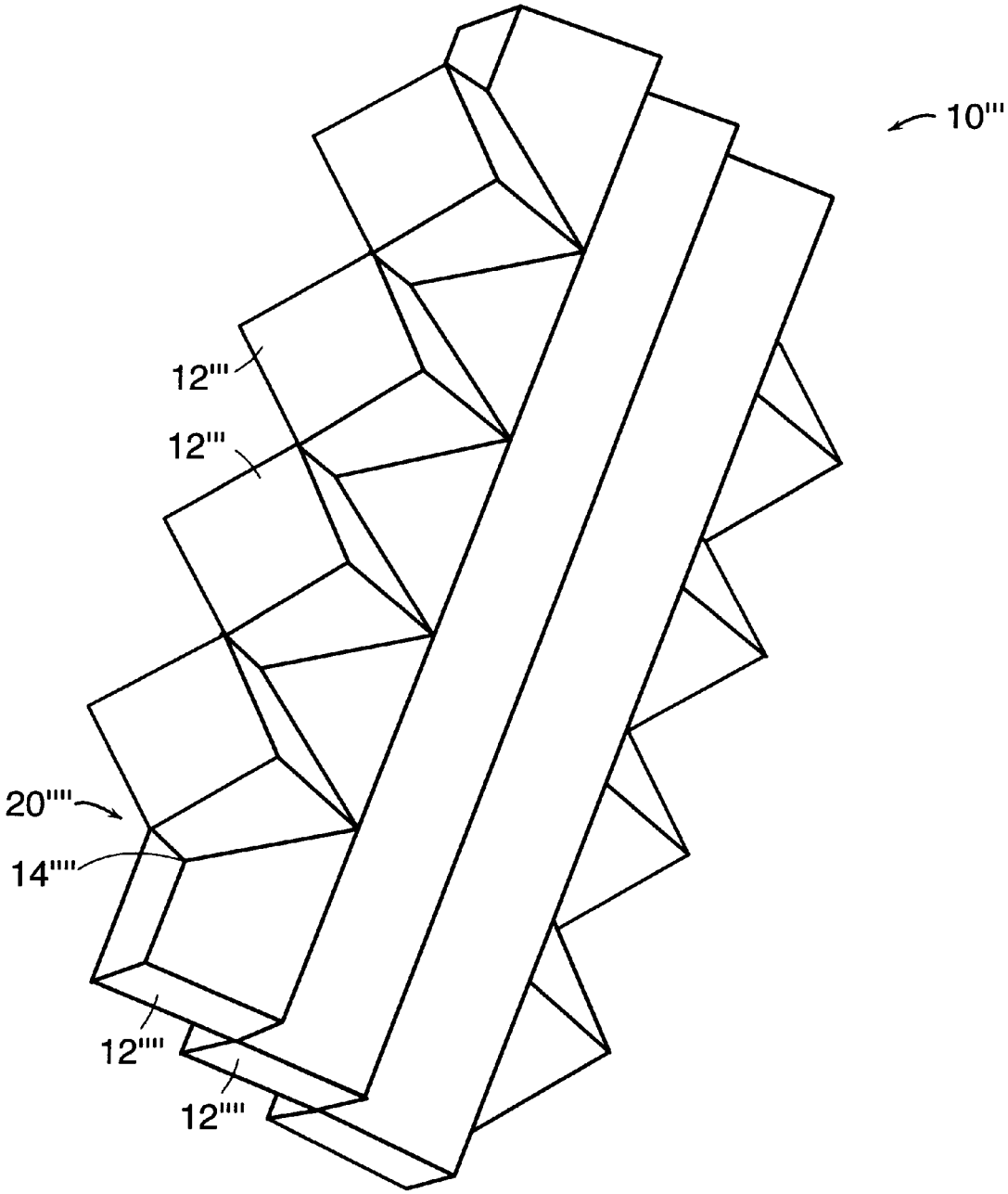
FIG. 12 is a perspective view of yet another embodiment of an assembled puzzle in accordance with the present invention.

FIG. 12 shows an embodiment of the puzzle in accordance with the present invention, indicated by the numeral 10'", that is similar to the puzzle 10 shown in FIG. 1, but consists of seven pieces, including four pieces 12'"0 and three pieces 12"", as compared to the six pieces 12 which comprise the puzzle 10. On the one hand, the pieces 12'" have the same configuration as the pieces 12. On the other hand, the pieces 12"" each have a cavity 14"", the dimensions of which are such that the opening 20"" along one edge of the piece 12"" is at least 3.0×d"" and the floor 16"" of the cavity is rectangular having a width with a dimension d"" and a length at least 4.0×d"". The pieces 12"" and 12"" are assembled in a manner similar to that described in connection with the embodiment described in connection with FIGS. 1–7.

Figure 13:
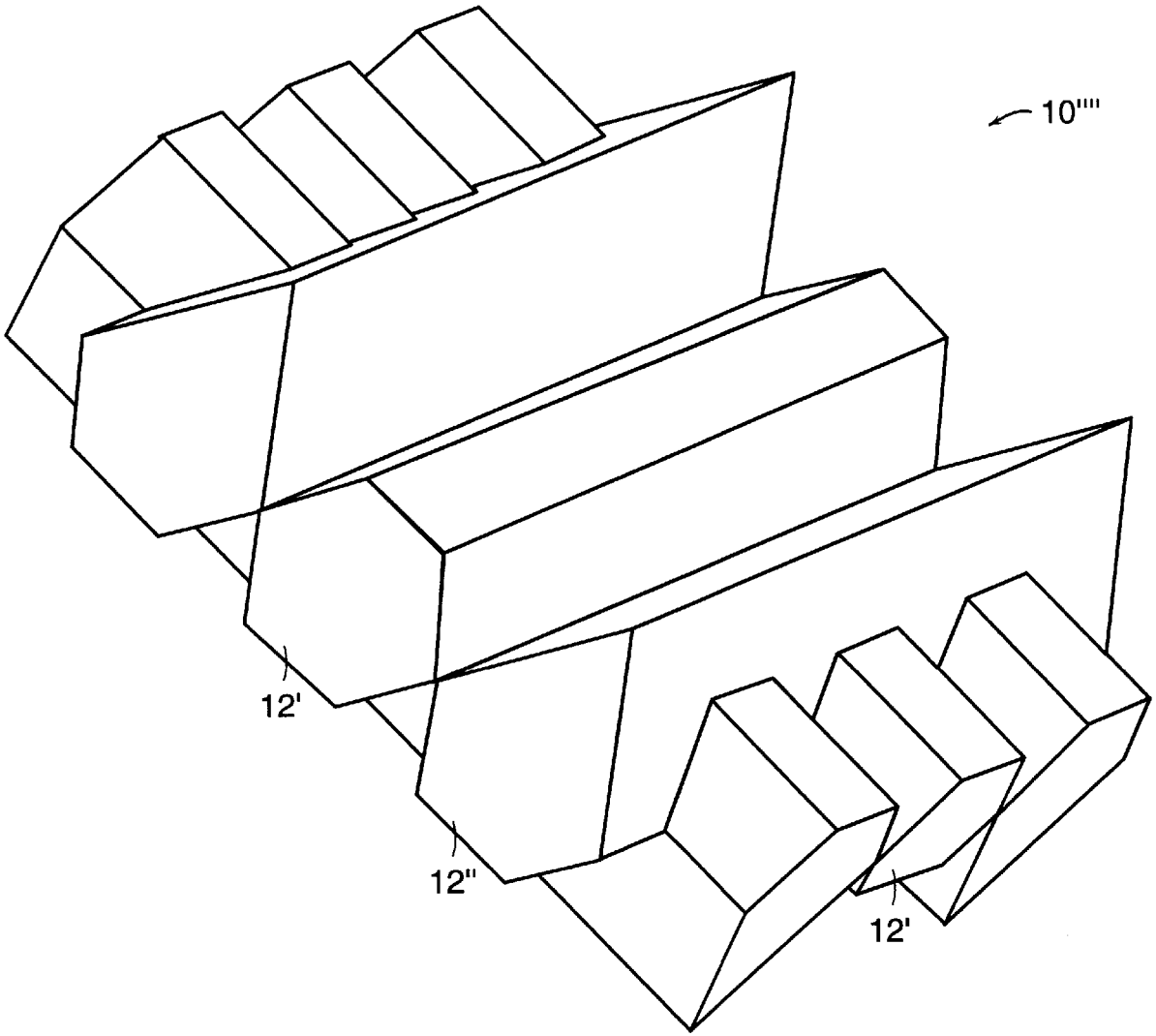
FIG. 13 is a perspective view of still another embodiment of an assembled puzzle in accordance with the present invention.

FIG. 13 shows an embodiment of the puzzle in accordance with the present invention, indicated by the numeral 10"", comprising two pieces 12', such as shown in FIG. 8, and four pieces 12", such as shown in FIG. 11. The puzzle 10"" is assembled in the same manner as the puzzle shown in FIG. 11.

Figure 14:
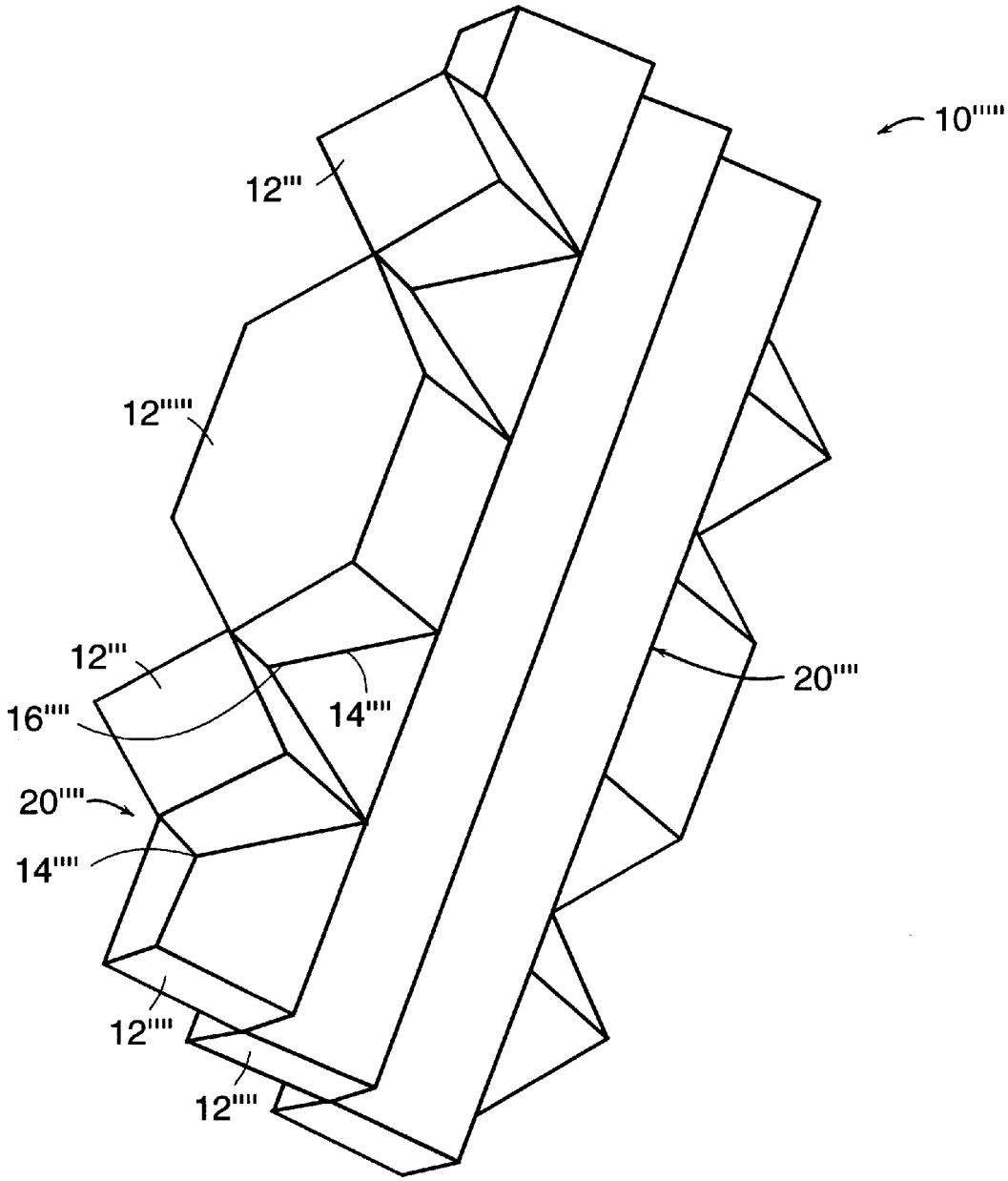
FIG. 14 is a perspective view of another embodiment of an assembled puzzle in accordance with the present invention.

FIG. 14 shows an embodiment of the puzzle in accordance with the present invention, indicated by the numeral 10"", that is similar to the puzzle 10'" shown in FIG. 12, but consists of six pieces instead of the seven pieces shown in FIG. 12. The puzzle 10"" includes two pieces 12'" and three pieces"" identical to the correspondingly numbered pieces shown in FIG. 12. Additionally, the puzzle 10"" comprises a sixth piece 12"" which is equivalent to the two middle pieces 12'" shown in FIG. 12 combined. On the one hand, the pieces 12'" and 12"" have the same dimensions as the correspondingly numbered pieces shown in FIG. 12. On the other hand, the piece 12"" has a cavity 14"", the dimensions of which are such that the opening 20"" along one edge of the piece 12"" is at least 2.0×d"" and the floor 16"" of the cavity is rectangular having a width with a dimension 2.0×d"" and a length at least 3.0×d"". The pieces 12'", 12"", and 12"" are assembled in a manner similar to that described in connection with the embodiment described in connection with FIGS. 1–7.

While various embodiments of a mechanical puzzle assembly are described above, the principles of the present invention also apply to puzzles in which the configuration of the puzzle pieces is modified. For example, in a modified embodiment of the puzzle shown in FIGS. 1–7 in which the pieces have a square cross-section, one or both of the two pieces 12 comprising the middle pieces of each group during assembly, that is, the pieces 12C, may have an arbitrary configuration on the portion of the piece which faces away from the opposing pieces when the puzzle is assembled, such as a relieved portion 12CA or an extended portion 12CB, respectively, as shown in dotted lines in FIG. 7. Also, the present invention generally teaches fastening together parallel groups of elongated pieces of solid material, of a class of polygonal cross-sections, without the use of extraneous materials. The present invention utilizes precisely sized cavities in the pieces to join with similar cavities in other pieces of the same or similar material to form a solid, stable connection without the use of nails, screws, glue, or other fastening devices. Therefore, although the present invention has been described in connection with three-dimensional mechanical puzzles, it will be readily apparent to persons skilled in the art that other articles of manufacture can be constructed in accordance with the present invention, including frames for pictures or windows; enclosures for cables, rods, and other elongated materials; religious icons; etc. These and other changes and modifications and applications of the present invention to construction of various articles of manufacture can be made without departing from the scope of the invention as defined by the appended claims.

Having described my invention, what I desire to claim and secure by Letters Patent is:

1. A puzzle assembly comprising:

at least six elongated interengageable puzzle pieces having polygonal cross-sections, each piece having a cavity extending along the length of the piece, the cavity being dimensioned to receive portions of at least three of the other pieces, the cavity having a floor and first and second end walls, each end wall being disposed at an acute angle to the floor;

the puzzle pieces being configured to be selectively joined in an interlocking, self-supporting configuration by the end walls such that two groups of at least three pieces each partially contain and constrain the motion of the other group of at least three pieces along all three coordinate axes, so that no individual piece may move without the cooperating movement of all other pieces.

2. A puzzle as defined in claim 1 wherein each puzzle piece is substantially identical.

3. A puzzle as defined in claim 1 wherein the cavity of each puzzle piece is bounded by a floor and two end walls, each of the end walls extending from the floor of the cavity to an edge of the piece.

4. A puzzle as defined in claim 3 wherein the floor of the cavity of each puzzle piece is substantially rectangular and whose longer sides coincide with two opposite edges of the piece.

5. A puzzle as defined in claim 3 wherein the floor of the cavity of each puzzle piece is substantially rectangular and whose shorter sides are substantially perpendicular to two opposite edges of the piece.

6. A puzzle as defined in claim 3 wherein each of the end walls of the cavity of the puzzle piece extends from one side of the piece to a side adjacent to the opposite side of the piece.

7. A puzzle as defined in claim 3 wherein each of the end walls of the cavity of the puzzle piece extends from the floor of the cavity between a pair of opposite edges of the piece to another edge of the piece.

8. A puzzle as defined in claim 3 wherein each end wall of the cavity of the puzzle piece forms an interior angle with the floor of the cavity that is the same as the angle between the floor of the cavity and an outer surface of an adjoining side of the piece.

9. An article of manufacture comprising:

at least six elongated pieces constructed of solid material, each of the pieces having a polygonal cross-section; and a cavity formed in each piece that enables pieces to interlock and grip each other, the cavity having a floor and first and second end walls, each end wall being disposed at an acute angle to the floor such that the end walls partially contain and constrain the motion of the pieces along all three coordinate axes, so that no individual piece may move without the cooperating movement of all other pieces;

the cavity in each piece being dimensioned so as to permit at least three other pieces to fit substantially parallel to each other within the cavity and at a substantially right angle to each piece in whose cavity the substantially parallel pieces are disposed.

10. The article as defined in claim 9 wherein the pieces are substantially identical.

11. The article as defined in claim 9 wherein at least two of the pieces differ in at least one of decoration, length, or embellishment.

12. The article as defined in claim 9 wherein at least two of the pieces have different polygonal cross-sections.

13. The article as defined in claim 9 wherein the pieces have at least one of a square, hexagonal, and pentagonal cross-section.

14. The article as defined in claim 9 wherein the article comprises at least seven pieces.

15. The article as defined in claim 9 wherein at least two of the pieces have different diagonal widths.

16. A method for assembling an article of manufacture, comprising the steps of:

providing at least six elongated pieces constructed of solid material, each of the pieces having a polygonal cross-section and a cavity formed in each piece that enables pieces to interlock and grip each other, the cavity in each piece being dimensioned so as to permit at least three other pieces to fit substantially parallel to each other within the cavity and at a substantially right angle to each piece in whose cavity the substantially parallel pieces are disposed;

dividing the pieces into two groups of at least three each, comprising at least two outer pieces and at least one middle piece;

for each group, placing the at least three pieces in each group together so that the at least two outer pieces are parallel with the middle piece between them such that the cavities of all of the pieces in the group are oriented in the same direction;

advancing the two groups toward each other, with the cavities of the pieces of the respective groups facing toward each other, until the outer pieces of the two groups are moved into contact with the floors of the cavities of the outer pieces of one group substantially perpendicular and disposed in close contact with the floors of the cavities of the outer pieces of the other group;

placing the middle piece of each group so that points along one edge of each middle piece span the floors of the cavities of the outer pieces of the opposing group and reach beyond their edges; and sliding the outer pieces of each group apart while simultaneously sliding the middle piece toward the opposing group until the middle pieces of the two groups meet, thereby completing assembly.

17. The method as defined in claim 16, further comprising the step of:

disassembling the article by pulling the middle piece of each group as far apart from each other as possible while simultaneously squeezing the outer pieces in each group toward each other, combining pulling and squeezing until all of the pieces separate.

18. The method as defined in claim 16 wherein there are an equal number of pieces in each opposing group of pieces.

19. The method as defined in claim 16 wherein the number of pieces in one group differs from the number of pieces in the other group.

* * * * *